United States Patent [19]

Kuus et al.

[11] 3,953,755

[45] Apr. 27, 1976

[54] HIGH PRESSURE GAS DISCHARGE LAMP INCLUDING A HYDROGEN GETTER

[75] Inventors: Gijsbert Kuus; Piet Wiedijk, both of Eindhoven, Netherlands

[73] Assignee: U.S. Philips Corporation, New York, N.Y.

[22] Filed: Nov. 1, 1974

[21] Appl. No.: 519,948

[30] Foreign Application Priority Data

Nov. 15, 1973 Netherlands ..... 7315641

[52] U.S. Cl. ..... 313/174; 313/178; 313/184; 417/48

[51] Int. Cl.[2] ..... F04B 37/02; H01J 61/26

[58] Field of Search ..... 313/174, 178, 184; 417/48

[56] References Cited

UNITED STATES PATENTS

| | | | |
|---|---|---|---|
| 3,331,988 | 7/1967 | Lafferty | 313/178 X |
| 3,558,963 | 1/1971 | Hanneman et al. | 313/178 X |
| 3,805,105 | 4/1974 | Gungle | 313/184 X |

*Primary Examiner*—Palmer C. Demeo
*Attorney, Agent, or Firm*—Frank R. Trifari

[57] ABSTRACT

A high-pressure gas discharge lamp having a discharge vessel provided with an aggressive gas filling, and electrodes between which the discharge takes place during operation. A hydrogen getter is placed within the discharge vessel and it consists of a getter material surrounded by a hydrogen-permeable wall. The getter material comprises at least a material of the group yttrium, lanthanum, the lanthanides and alloys of the said elements. The hydrogen permeable wall comprises at least one of the elements chromium, molybdenum, tungsten, tantalum, nickel and iron.

13 Claims, 5 Drawing Figures

HIGH PRESSURE GAS DISCHARGE LAMP INCLUDING A HYDROGEN GETTER

The invention relates to a high pressure gas discharge lamp comprising a discharge vessel containing an aggressive gas filling and being provided with a hydrogen getter located within the discharge vessel. More particularly the invention relates to high-pressure mercury vapour discharge lamps and high pressure metal halide vapour discharge lamps provided with such a hydrogen getter. Furthermore the invention relates to the said hydrogen getter itself.

High pressure gas discharge lamps comprise a gas filling in which the discharge is maintained. This gas filling may consist of, for example, one or more rare gases, mercury, cadmium, sodium, one or more metal halides or mixtures of these elements and compounds. Many of these gas filling components may react in an unwanted manner with the lamp parts. Consequently for the lamp parts which are in contact with the gas filling materials resistant to the gas filling are chosen. In high pressure sodium vapour discharge lamps, for example, a sodium resistant discharge vessel is used. In high pressure mercury vapour and high pressure metal halide vapour discharge lamps quartz is generally used as a material for the discharge vessel and tungsten as an electrode material. In this description and the claims an aggressive gas filling is understood to mean a gas filling comprising at least one component which at least at the operating temperature of the lamp may attack a lamp part due to chemical and/or physical reactions.

It is generally desirable to limit the occurrence of gaseous impurities in gas discharge lamps as much as possible. These impurities may be introduced when manufacturing the lamps. It is alternatively possible that they are released from the wall of the lamp or the lamp filling during the lifetime of the lamp. It has been found that especially the presence of hydrogen in gas discharge lamps is very disturbing because hydrogen causes a considerable increase of the ignition voltage and also of the reignition voltage of these lamps, even when it is present in very small quantities. It is possible to maintain the hydrogen content of these lamps within acceptable limits by taking extra steps during their manufacture. However, these extra steps make the lamp considerably more expensive and it has also been found that the hydrogen content, particularly during the lifetime of the lamp, cannot be reproducibly controlled.

It is known to use a hydrogen getter in discharge lamps. Proposed getter material is, for example, thorium, hafnium, zirconium, titanium, yttrium, lanthanum and the lanthanides which are provided in small quantities in the lamp. A great drawback of the said getter materials is that they are attacked by a reactive gas filling in the lamp so that they cannot be used in many lamp types.

Soviet Union Patent Specification No. 307,444 describes a high-pressure metal halide vapour discharge lamp which in addition to mercury and optionally a rare gas for ignition comprises one or more metal halides and is provided with a hydrogen getter present within the discharge vessel and consisting of titanium, zirconium or thorium as a getter material. This getter material is surrounded by a wall permeable to hydrogen and consisting of a quartz glass ampoule. At an elevated temperature quartz glass is slightly permeable to hydrogen and is not attacked by most halogens and halides. A drawback of the hydrogen getter described in the Soviet Patent Specification is that the getter only acts satisfactorily at temperatures of less than 600°C. Generally it is, however, required in these types of lamps that the temperature of the coldest spot in the lamp during operation is 600°C or more. The use of the known hydrogen getter at temperatures of more than 600°C would require a large quantity of getter material unacceptable in practice in order to bind sufficient hydrogen and furthermore has the drawback that the said getter materials react with the quartz of the capsule at these elevated temperatures.

It is to be noted that an incandescent lamp is known from German Patent Application No. 2,020,981 which lamp is provided with a quantity of iodine to maintain the so-called tungsten-halogen cycle. In order to bind hydrogen in this aggressive lamp atmosphere it is proposed to use a hydrogen getter consisting of titanium, tantalum, zirconium or aluminium and coated with a hydrogen-permeable coating which is impermeable to iodine. This hydrogen-permeable coating consists of palladium or a palladium-nickel alloy. The use of this hydrogen getter in high-pressure gas discharge lamps has the drawback that the said known getter is only active at low temperatures (far below 600°C). In gas discharge lamps comprising mercury this getter is neither applicable because mercury can constitute an alloy with palladium so that the getter is attacked.

It is an object of the invention to provide high pressure gas discharge lamps having an efficient hydrogen getter which is active at relatively high temperatures and which is resistant to a large number of gas filling components possibly present in the lamp.

A high pressure gas discharge lamp according to the invention has a discharge vessel comprising an aggressive gas filling and being provided with electrodes between which the discharge takes place during operation, and a hydrogen getter located within the discharge vessel and consisting of a getter material surrounded by a hydrogen-permeable wall and is characterized in that the getter material comprises at least a material from the group yttrium, lanthanum, the lanthanides and alloys of the said elements, the hydrogen-permeable wall comprising at least one of the elements chromium, molybdenum, tungsten, tantalum, nickel and iron.

The elements to be used as getter material in a lamp according to the invention are the lanthanides, sometimes referred to as rare earth metals, and the metals yttrium and lanthanum which physically and chemically are quite conform to the lanthanides. The said getter materials have a large getter capacitance for hydrogen and a large getter speed. These eminent getter properties are achieved if these materials are brought to a relatively high temperature (at 600°C and far more). This makes these getters extremely suitable for use in high-pressure gas discharge lamps. Since the getter materials to be used are attacked by the aggressive gas filling in the lamp, the hydrogen getter in a lamp according to the invention is surrounded by a wall which is permeable to hydrogen. In addition to permeability to hydrogen the requirement is imposed on the material of this wall that it does not pass the aggressive gas filling components and that it is not attacked by these gas filling components. The materials chromium, molybdenum, tungsten, tantalum, nickel and iron to be used for the hydrogen-permeable wall of the hydrogen getter according to the invention are eminently resistant to gas filling components such as sodium, mercury, cadmium and metal halides.

A high pressure gas discharge lamp having a hydrogen getter according to the invention in which the hydrogen-permeable wall consists of a coating of one or more of the elements, chromium, molybdenum, tungsten and tantalum having a thickness of between 0.1 and 100 $\mu$ provided on the getter material is preferred. This coating may be provided on the getter material in different manners. One of the possible techniques is known as "ion plating". The article to be coated is brought to a high negative voltage. The material to be provided on the article is brought to a high temperature in a vapour deposition source and an argon discharge is maintained between the vapour deposition source and the article so that the evaporating particles are positively charged and are deposited on the article. Another technique is vapour deposition (deposition from the gas phase). The article to be coated is brought to a high temperature whereafter a volatile compound of the metal to be provided (for example, a chloride) is contacted with the article. The volatile compound is reduced on the article to be coated while the metal is deposited. A continuous omnilateral coating can be achieved in the manners described above. The preferred embodiment described above of a hydrogen getter according to the invention has the advantage that very thin coatings very permeable to hydrogen can be obtained. This is possible because the used metals chromium, molybdenum, tungsten and tantalum do not react with the getter materials to be used. The thickness of the coating provided on the getter material is chosen to be not less than 0.1 $\mu$ because at such small thickness an omnilateral continuous coating is hardly possible in practice. Also for relatively thick coatings (up to 100 $\mu$) an eminent hydrogen permeability is obtained.

In a further advantageous embodiment of the above-mentioned preferred hydrogen getter according to the invention the getter material is mixed or alloyed with the element (or the elements) constituting the hydrogen-permeable wall. The mixture or alloy comprises not more than 90% by weight of the elements Cr, Mo, W and Ta. The said mixture or alloy has the advantage that a better adhesion of the hydrogen-permeable coating to the getter material is obtained and that diffusion, possibly, occurring, of the permeable coating in the getter material is inhibited.

A further preferred embodiment of a lamp according to the invention has a hydrogen getter whose hydrogen-permeable wall consists of a closed capsule of molybdenum, tungsten or tantalum within which the getter material is present and whose wall thickness has a value of between 5 and 500 $\mu$. The metals molybdenum, tungsten and tantalum may be obtained in thin foils which have a satisfactory permeability to hydrogen at the operating temperature of the getter. An advantage of this embodiment is that the hydrogen getter can easily be manufactured. Since Mo, W and Ta do not react with the getter materials to be used no extra precautions are to be taken to avoid contact between getter material and capsule. The wall thickness of the capsule is larger than approximately 5 $\mu$ because thinner foils can hardly be made in practice and is chosen to be not more than 500 $\mu$ because the permeability to hydrogen becomes too little in case of larger thicknesses. It is particularly advantageous in this embodiment of the invention to choose tantalum as a material for the capsule. In fact, as compared with molybdenum and tungsten, tantalum has the highest hydrogen permeability and the additional advantage that it can bind gases such as oxygen, carbon monoxide, carbon dioxide and nitrogen. The removal of the said gases from the lamp is very desirable in many cases. When binding the said gases, non-volatile compounds are formed which are not disturbing in the lamp. Furthermore tantalum has the property of decomposing traces of water in the lamp. The tantalum oxide then formed is not disturbing and the hydrogen formed is bound by the getter material.

Still a further embodiment of a lamp according to the invention, which is preferred, is provided with a hydrogen getter whose hydrogen-permeable wall consists of a closed capsule of nickel, iron, an alloy of nickel and iron, or an alloy of nickel and/or iron and one or more of the elements chromium, molybdenum, tungsten and tantalum, the wall thickness of this capsule being between 5 and 500 $\mu$ and the getter material being provided within the capsule in such a manner that direct contact between getter material and capsule is impossible. The capsules of the materials mentioned above can be manufactured at a lower cost than the above-described capsules of Mo, W and Ta. An advantage of nickel, iron and their alloys is that these materials have a permeability to hydrogen which is equal to or even more than that of tantalum. The said materials for the capsule wall must, however, not be in direct contact with the getter material in this case because mutual alloys may be produced so that the hydrogen getter might become defective.

In the latter embodiment of a hydrogen getter according to the invention a porous coating is preferably used which consists of a non-reactive material and is present between the getter material and the capsule wall. In this manner a direct contact between getter material and capsule is impossible and due to the porosity of the coating the transport of hydrogen is substantially not inhibited. Pulverulent coatings of rare earth oxides or nitrides of titanium, zirconium, hafnium, lanthanum and cerium are suitable as porous coatings.

Another advantageous method to exclude direct contact between getter material and capsule is to place supporting elements consisting of sintered bodies of rare earth oxides or of nitrides of titanium, zirconium, hafnium, lanthanum and cerium or consisting of molybdenum, tungsten or tantalum, for example, in the form of supports or spacers. This solution has the advantage that direct contact between getter material and capsule wall is prevented with great certainty.

Nickel or nickel alloys (at least 50% by weight of Ni) is preferred as a material for the capsule wall, because this material is found to have the highest hydrogen permeability.

Although all mentioned getter materials have comparable properties, the use of yttrium as a getter material in a lamp according to the invention is preferred. In fact, yttrium has the greatest getter capacitance for hydrogen. Furthermore the hydrogen residual pressure above the getter is lowest when using yttrium as a getter material.

A high pressure gas discharge lamp according to the invention is preferably formed as a high pressure mercury vapour discharge lamp comprising a quantity of mercury completely evaporating during operation and furthermore generally a quantity of rare gas as a starter gas. Due to slight quantities of hydrogen in the lamp these kinds of lamps often exhibit an unwanted high ignition and reignition voltage. When using a hydrogen getter according to the invention in these lamps the said voltages are reduced to acceptable values.

The said ignition and reignition problems are still more serious in high pressure metal halide vapour discharge lamps. So far these difficulties have been partly solved by taking extra, costly precautions during manufacture. A high pressure metal halide vapour discharge lamp according to the invention comprising at least a metal halide and optionally a quantity of mercury may be manufactured in a considerably simpler manner. Consequently this type of gas discharge lamp according to the invention is preferred.

The invention will now be further described with reference to a drawing.

Figure 1:
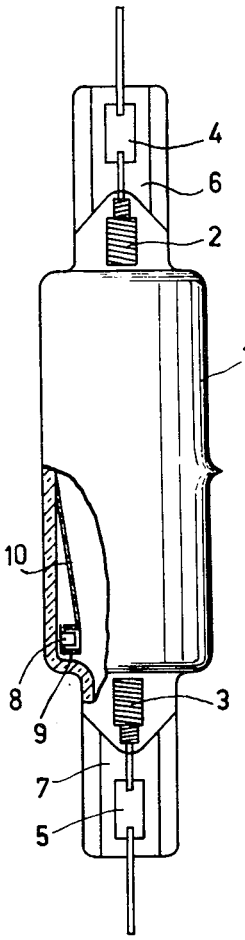
FIG. 1 shows an embodiment partly in a cross-section of a high-pressure gas discharge lamp according to the invention and FIG. 2 shows the hydrogen getter used in the lamp of FIG. 1, in a cross-section and on a larger scale.

In FIG. 1, the reference numeral 1 denotes the tubular quartz glass discharge vessel of a high pressure metal halide vapour discharge lamp according to the invention. Tungsten electrodes 2 and 3 passed in a vacuum-tight manner through the pinches 6 and 7 by means of molybdenum foils 4 and 5, respectively, are provided at the ends of the tube 1. The tube 1 which in practice is generally provided in a glass outer envelope (not shown in the drawing) is provided with a quantity of mercury completely evaporating during operation of the lamp and in addition to a slight quantity of argon as a starter gas it also includes the iodides of sodium, thallium and indium. The internal diameter of the tube 1 is 15 mm and the distance between the electrodes 2 and 3 is 41 mm. The lamp is intended for a power of 400 W. A hydrogen getter 8 according to the invention is provided within the tube 1. The getter 8 consists of a closed capsule of tantalum, in which a quantity of yttrium is provided. The capsule 8 is fixed to the wall of the tube 1 by means of a quartz glass cylinder 9. The cylinder 9 is fixed to one end of a quartz glass rod 10 the other end of which is fused to the wall of tube 1. The position of the hydrogen getter 8 is chosen to be such that it reaches a temperature of approximately 900°C during operation of the lamp.

Figure 2:
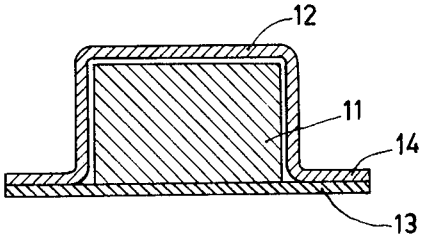

FIG. 2 shows the hydrogen getter 8 of the lamp of FIG. 1 on a larger scale in a cross-section. The tantalum capsule consists of a cylindrical box 12 provided with an edge 14. the box 12 is closed in a gastight manner by means of a tantalum cover 13. The thickness of the box 12 and the cover 13 is approximately 100 $\mu$. The gastight closure is obtained by resistance welding of the edge 14 to the cover 13. The capsule includes a cylinder 11 of yttrium metal. The cylinder 11 has a diameter of approximately 1.6 mm and a height of approximately 1 mm (approximately 10 mg yttrium). In order to determine the getter properties of the above-described hydrogen getter the following test was conducted. The hydrogen getter was introduced into an evacuated space (contents 150 cc) and heated to a temperature of approximately 900°C. Subsequently hydrogen was admitted within the evacuated space up to a pressure of $5.10^{-1}$ Torr. At the said temperature of 900°C a getter capacity of 67.5 Torr cc was measured, a getter speed of 25 cc/min and a hydrogen residual pressure above the hydrogen-saturated getter of $5.10^{-2}$ Torr.

Figure 3:
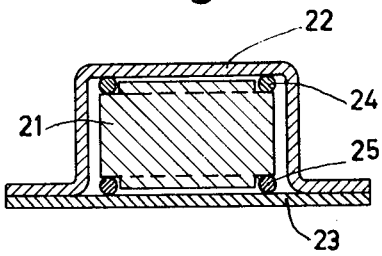
FIG. 3 shows in a cross-section a further embodiment of a hydrogen getter according to the invention and FIG. 4 shows another embodiment of a hydrogen getter according to the invention.

The hydrogen getter of FIG. 3 consists of a nickel capsule having the same shape and dimensions as the tantalum capsule of FIG. 2. The box 22 is again connected by resistance welding to the cover 23. The capsule comprises approximately 10 mg yttrium in the form of a cylinder 21. Rings 24 and 25 of tungsten serve as supporting elements for the yttrium cylinder 21. The rings 24 and 25 engaging circular recesses in the top and bottom faces of the cylinder 21 maintain the cylinder 21 at some distance from the capsule wall so that direct contact between yttrium and nickel is impossible. In this manner the formation of unwanted nickel-yttrium compounds is prevented.

Figure 4:
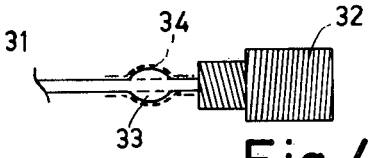

FIG. 4 shows an electrode suitable for a high-pressure gas discharge lamp according to the invention and provided with a hydrogen getter. The electrode consists of a tungsten electrode bar 31 supporting at one end an electrode coil 32 formed as a tungsten double coil. A hydrogen getter (33, 34) is placed at a slight distance from the coil 32 around the electrode bar 31. The getter consists of a getter material 33 (a mixture of yttrium and chromium) which is omnilaterally coated with a chromium coating 34 (thickness approximately 10 $\mu$). The getter (33, 34) is provided as follows. The starting mixture is a mixture of 86% by weight of yttrium hydride and 14% by weight of chromium. A ring is moulded of this mixture around the electrode bar 31. Subsequently the electrode bar 31 is heated with the aid of a high frequency coil in an inert atmosphere, for example, in argon to just above the melting point of the ring (approximately 1,300°C). During this heat treatment the yttrium hydride is converted into yttrium and the getter material 33 (a homogeneous mixture of yttrium and chromium) is obtained in the form of an evenly flowing drop. The getter material 33 is subsequently coated by means of ion plating with a chromium coating 34 having a thickness of approximately 10 $\mu$.

Figure 5:
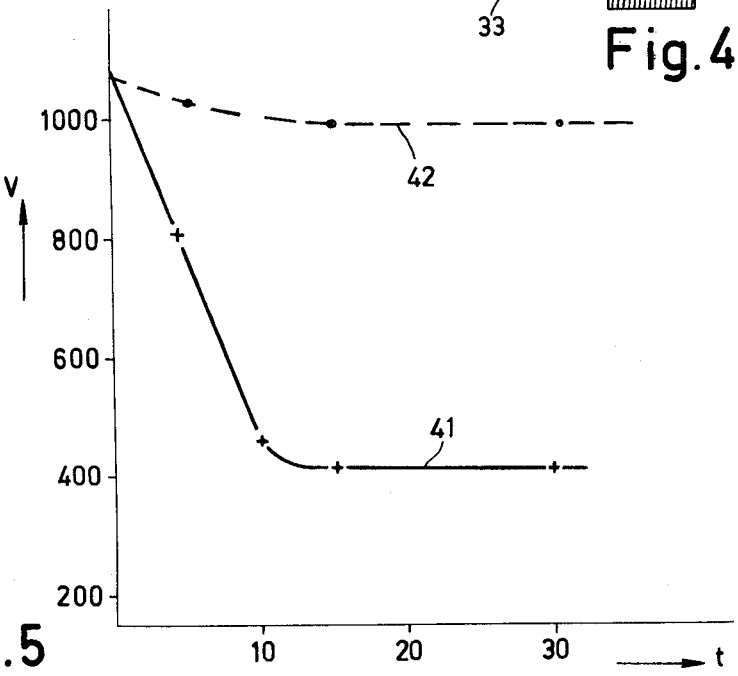
FIG. 5 shows in a graph the variation of the ignition voltage of lamps as shown in FIG. 1 as a function of the operation time of the lamps.

The ignition voltage of the lamp comprising metal halides as described with reference to FIG. 1 was measured at different instants during the operating time of the lamp. FIG. 5 shows these measurements in a graph. The operating time $t$ is plotted in minutes on the horizontal axis and the ignition voltage V in volt is plotted on the vertical axis. It is found that for this lamp comprising argon as a starter gas the voltage upon the first ignition ($t$=0) is high, namely approximately 1,100 V. This high ignition voltage is a result of the impurities, predominantly hydrogen, initially present in the lamp. The quantity of hydrogen is relatively large because in the manufacture of the lamp the usual precautions (such as a longlasting heat treatment of discharge tube and lamp parts at a high temperature) have not been carried out. The measuring points for the lamp according to the invention (in the graph of FIG. 5 connected by the curve 41) show, however, that the hydrogen is quickly bound by the getter during the first part of the operating time so that after approximately 10 minutes of operation an ignition voltage of already approximately 400 V is obtained. It is to be noted that considerably lower values of the ignition voltage are obtained with lamps comprising a mixture of neon and argon as a starter gas. Also the reignition voltage exhibits the same very favourable behaviour of a drastic decrease during the first minutes of operation. For the purpose of comparison FIG. 5 includes the measurements of a lamp not comprising a hydrogen getter, but otherwise being completely identical to the lamp according to FIG. 1. This lamp (not according to the invention) was manufactured in an analogous manner as the lamp of FIG. 1. The measuring points for this lamp (in the graph of FIG. 5 connected by the broken line curve 42) show that the lamp has the same high initial ignition voltage (approximately 1,100 V) as the lamp according to the invention. However, during the operating time a very high ignition voltage (approximately 1,000 V) is maintained in this lamp after an initial slight decrease in the ignition voltage.

What is claimed is:

1. A high-pressure gas discharge lamp including a sealed, translucent discharge vessel containing an aggressive gas filling and being provided with electrodes between which the discharge takes place during operation, and a hydrogen getter located within the discharge vessel and consisting of a getter material surrounded by a hydrogen-permeable wall, characterized in that the getter material comprises at least a material of the group yttrium, lanthanum, the lanthanides and alloys of the said elements and that the hydrogen-permeable wall comprises at least one of the elements chromium, molybdenum, tungsten, tantalum, nickel and iron.

2. A high-pressure gas discharge lamp as claimed in claim 1, characterized in that the hydrogen-permeable wall consists of a coating of chromium, molybdenum, tungsten and/or tantalum with a thickness of between 0.1 and 100 $\mu$ provided on the getter material.

3. A high-pressure gas discharge lamp as claimed in claim 2, characterized in that the getter material is mixed or alloyed with the element (or the elements) constituting the hydrogen-permeable wall, the mixture or the alloy comprising not more than 90% by weight of one or more of the elements chromium, molybdenum, tungsten and tantalum.

4. A high-pressure gas discharge lamp as claimed in claim 1, characterized in that the hydrogen-permeable wall consists of a closed capsule of molybdenum, tungsten or tantalum within which the getter material is present and whose wall thickness is between 5 and 500 $\mu$.

5. A high-pressure gas discharge lamp as claimed in claim 4, characterized in that the capsule consists of tantalum.

6. A high-pressure gas discharge lamp as claimed in claim 1, characterized in that the hydrogen-permeable wall consists of a closed capsule of nickel, iron, an alloy of nickel and iron or an alloy of nickel and/or iron with one or more of the elements chromium, molybdenum, tungsten and tantalum, the wall thickness of said capsule being between 5 and 500 $\mu$, the getter material being provided within the capsule in such a manner that direct contact between getter material and capsule is impossible.

7. A high-pressure gas discharge lamp as claimed in claim 6, characterized in that a porous coating of non-reactive material is present between getter material and capsule wall.

8. A high-pressure gas discharge lamp as claimed in claim 6, characterized in that supporting elements consisting of sintered bodies of rare earth oxides or of nitrides of titanium, zirconium, hafnium, lanthanum and cerium or consisting of molybdenum, tungsten or tantalum are present which maintain the getter material at a distance from the capsule wall.

9. A high-pressure gas discharge lamp as claimed in claim 6, characterized in that the capsule mainly consists of nickel.

10. A high-pressure gas discharge lamp as claimed in claim 1, characterized in that the getter material is mainly yttrium.

11. A high-pressure mercury vapour discharge lamp as claimed in claim 1, in which the discharge vessel comprises a quantity of mercury completely evaporating during operation of the lamp.

12. A high-pressure metal halide vapour discharge lamp as claimed in claim 1 in which the discharge vessel comprises at least a metal halide and optionally a quantity of mercury.

13. A hydrogen getter suitable for a high-pressure gas discharge lamp, comprising a getter material surrounded by a hydrogen-permeable wall, characterized in that the getter material comprises at least a material of the group yttrium, lanthanum, the lanthanides and alloys of the said elements and that the hydrogen-permeable wall comprises at least one of the elements chromium, molybdenum, tungsten, tantalum, nickel and iron.

* * * * *